US006655058B2

(12) United States Patent
Brooks, III

(10) Patent No.: US 6,655,058 B2
(45) Date of Patent: Dec. 2, 2003

(54) LEVITATING DESKTOP NAMEPLATE

(76) Inventor: Del Charles Brooks, III, 3405 Lexington Dr., Tyler, TX (US) 75701

( * ) Notice: Subject to any disclaimer, the term of this patent is extended or adjusted under 35 U.S.C. 154(b) by 0 days.

(21) Appl. No.: 09/850,636

(22) Filed: May 7, 2001

(65) Prior Publication Data

US 2002/0162255 A1 Nov. 7, 2002

(51) Int. Cl.[7] ..... G09F 19/00

(52) U.S. Cl. ..... 40/426; 335/306

(58) Field of Search ..... 40/426; 335/306

(56) References Cited

U.S. PATENT DOCUMENTS

| | | | | | |
|---|---|---|---|---|---|
| 3,196,566 | A | * | 7/1965 | Littlefield | 40/426 |
| 3,874,102 | A | * | 4/1975 | Sheppard | 40/426 |
| 4,486,729 | A | * | 12/1984 | Lee | 335/306 |
| 4,690,657 | A | * | 9/1987 | Lodrick, Sr. | 446/134 |
| 4,901,456 | A | * | 2/1990 | Cotutsca | 40/711 |
| 5,692,329 | A | * | 12/1997 | Tang | 40/426 |

* cited by examiner

*Primary Examiner*—Cassandra H. Davis

(57) ABSTRACT

An identification device having a surface for the display of one's name, title, artwork, or other information which, after being positioned properly, gives the illusion of levitating without any visible supports. The device uses magnetic field repulsion to achieve this illusion with a simple, easy release mechanism for lateral stability.

14 Claims, 3 Drawing Sheets

LEVITATING DESKTOP NAMEPLATE

BACKGROUND OF THE INVENTION

1. Field of the Invention

The field of the invention is that of a display apparatus for personal identification which utilizes opposing magnetic fields in order to create a levitating illusion for the display surface.

2. General Background

In many businesses, it is desirable for a person to distinguish himself or herself and also inform others of their name and/or title in a non-obtrusive fashion. This is commonly accomplished in an office environment through the use of a simple desktop nameplate.

3. Discussion of the Prior Art

Desktop nameplates are common in almost all businesses and are produced in relatively simple form made of wood, plastic, and metal. Most are engraved, etched, or printed with a person's name and possibly title. They are, however, similar in overall construction and adequately convey the information.

In the art of magnetic levitation, the display apparatus disclosed in U.S. Pat. No. 4,178,707 (Littlefield) is commonly referenced. In this example, a first base magnet, formed as a bar uniformly polarized along its upper surface, repulses a second magnet enclosed in an object. A tether is attached to the object to provide lateral stability. The effect being that the magnetic repulsion counteracts gravity and the forces the object to remain toward the center of the first base magnet. This construction is lacking since it allows for only a simple object to be levitated with very limited movement or vibration experienced.

Another example of magnetic levitation is disclosed in U.S. Pat. No. 5,182,533 (Ritts) wherein a spinning axle is suspended over a plurality of magnets. The axle is found in most embodiments with two circular magnets located co-axially at either end of the axle. The base magnets are polarized and positioned to repel the axle. This easily counteracts gravity, but does not provide for stability along the same axis as the axle. This is accomplished through the use of a vertical wall against which the axle rests at one end. This would be unsightly for aesthetic purposes, but works well for the scientific demonstration object for which it is used. This example is lacking due to its simple form which conveys little information. The unsightly wall, against which the axle rests, is also a drawback even when it is made out of a clear material (which is common in its commercially successful embodiment).

4. Statement of Need

Some individuals would prefer to stand out and leave a lasting favorable impression upon others or prefer to have something different than others as a conversation piece. This can be performed by having an individualized novelty item in open view of others that accomplishes the same function as a nondescript item. In this case, a levitating desktop nameplate which conveys the basic information and is novel in its form can create a positive impression.

SUMMARY OF THE INVENTION

1. Objects of the Invention

The present invention relates to a desktop nameplate which "levitates" above its platform. It provides room for a name and title or artwork, depending upon the text size, and appears to float in midair. This is accomplished through strategic positioning of magnets in the base and in the nameplate itself.

In the preferred embodiment, the base of the assembly contains eight magnets positioned in groups of four at each end of the base. A small post extends vertically from the base and has a metal-tipped tether attached to it. The nameplate itself has a ball at each end, inside of which a magnet has been positioned. The tether is of a length such that the nameplate will be positioned slightly off center to the side away from the tether post.

In an alternate embodiment, the post and tether are replaced with a post or wall, and the nameplate is positioned slightly off center to the side toward the post or wall.

Further alterations of the preferred or alternate embodiments could include reducing the number of magnets from groups of four to groups of two. The nameplate will still need to be offset from the groups of magnets but will not levitate as high.

2. Principles of the Invention

A user inserts the metal end of the tether into a small hole in one of the balls and holds the nameplate in position over the base. The metal tip of the tether is held in place by the magnet located in the ball. Since the tether has positioned the nameplate slightly off center to the side away from the tether post, the tether and metal tip keep the nameplate from falling off of the magnetic field and provide lateral stability. The magnets in the nameplate balls are positioned to repel the magnets in the base assembly and counteract the effect of gravity. When the nameplate is properly positioned and the tether is drawn taught, the nameplate is released and will "levitate" over the base indefinitely or until it is knocked over. The tether is designed for easy release for any time in which the nameplate is knocked over or grasped by an observer.

In the alternate embodiment, the nameplate is positioned slightly off center toward the post or wall, and the post keeps the nameplate from falling off of the magnetic field. When the nameplate is properly positioned and placed against the post, the nameplate is released and will levitate.

DETAILED DESCRIPTION

Figure 1:
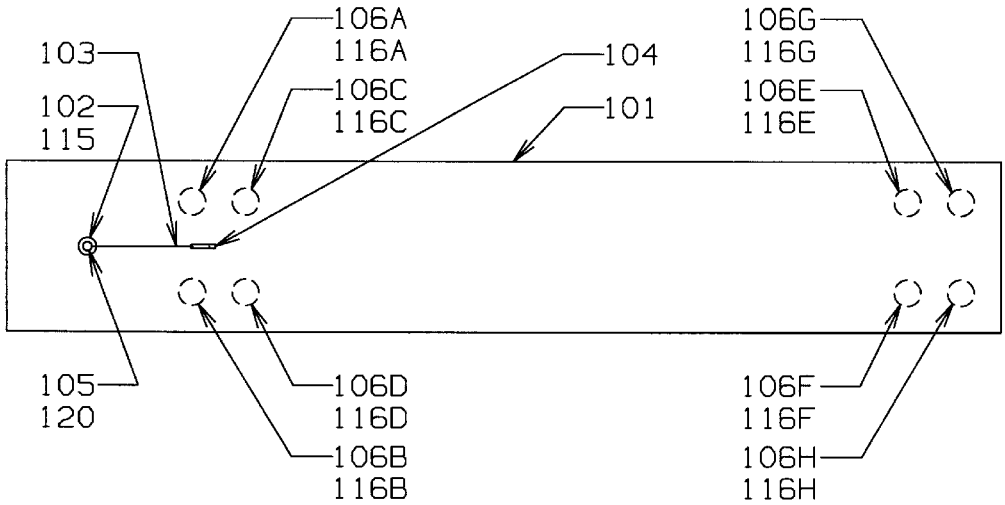
FIG. 1 is the top view of the base assembly of the present invention.
Figure 2:
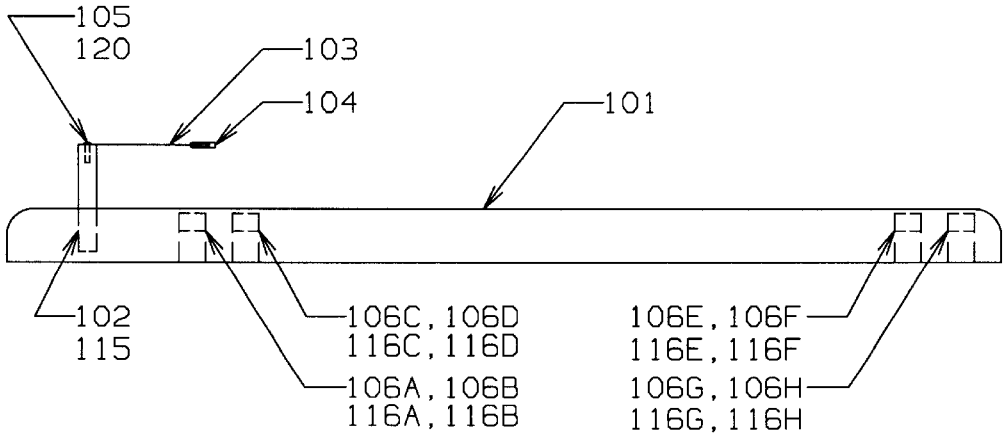
FIG. 2 is the front view of the base assembly of the present invention.

As shown in FIG. 1 and FIG. 2, eight magnets 106A, 106B, 106C, 106D, 106E, 106F, 106G, and 106H are inserted into the holes 116A, 116B, 116C, 116D, 116E, 116F, 116G, and 116H in base 101, with an exact lengthwise center to center measurement equal to the length of the nameplate plus the thickness of one magnet 111. The post 102 is inserted into hole 115 in base 101 and extends upward vertically so that the top of the post is even with the center of the levitating height. The tether 103 is attached to the post 102 by a screw 105 inserted into hole 120. The metal tip 104 is attached to the tether 103.

Figure 3:
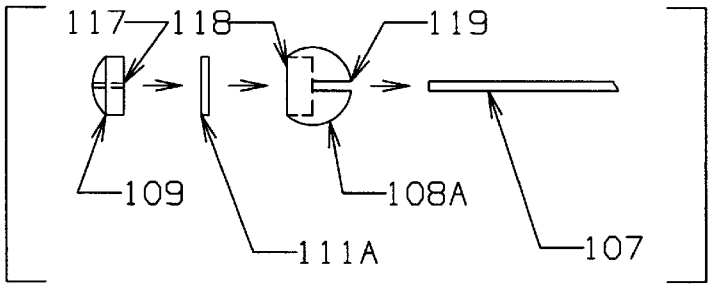
FIG. 3 is the top view of the assembly of the ball and nameplate components shown in FIG. 4.

Referring to FIG. 3, the plug 109 and magnet 111A are inserted into hole 118 of ball 108A and secured permanently. The plate 107 is then inserted into slot 119 of ball 108A and permanently secured to the resulting assembly of the plug 109, magnet 111A, and ball 108A. A similar assembly is made on the other end of the plate 107 using plug 110, magnet 111B, and ball 108B.

Figure 4:
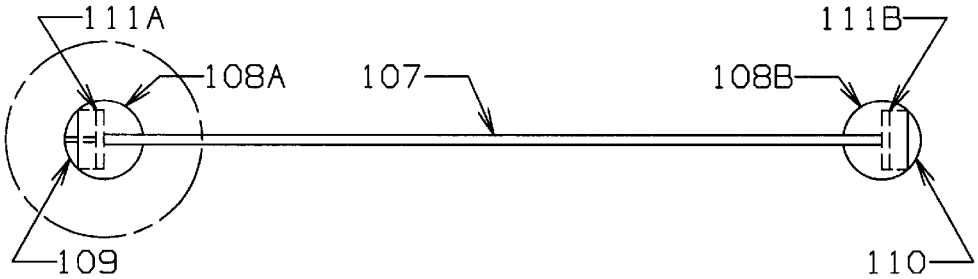
FIG. 4 is the top view of the nameplate assembly of the present invention.
Figure 5:
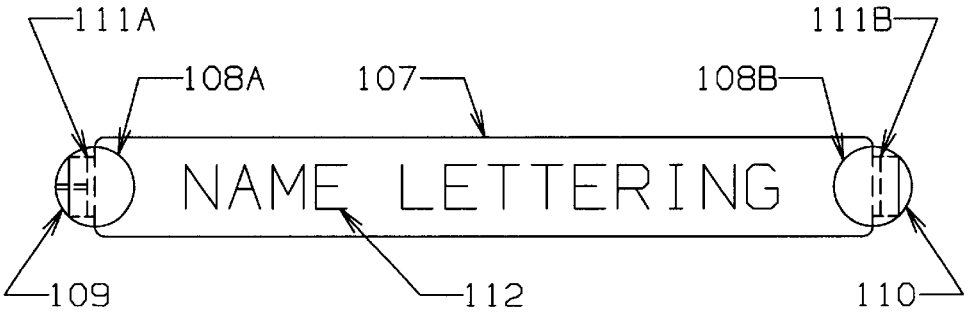
FIG. 5 is the front view of the nameplate assembly of the present invention.

In FIG. 4 and FIG. 5, the nameplate assembly is shown with the name lettering 112 printed, etched, or engraved on plate 107.

Figure 6:
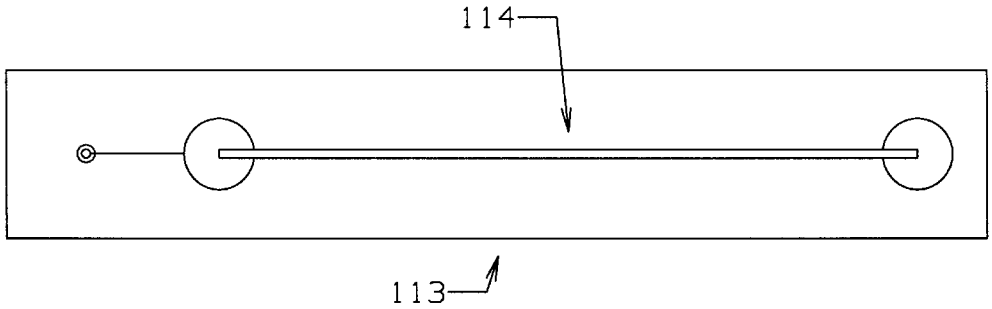
FIG. 6 is the top view of the assembly of both the base assembly and nameplate assembly.
Figure 7:
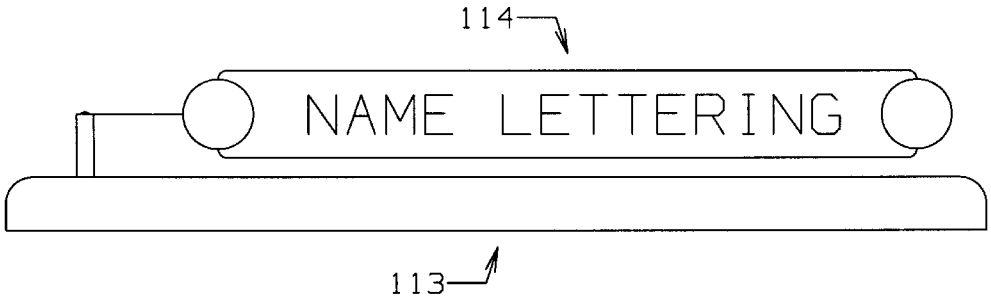
FIG. 7 is the front view of the assembly of both the base assembly and nameplate assembly.

In FIG. 6 and FIG. 7, the entire base assembly 113 and nameplate assembly 114 are shown in their "levitating" state and appear as they do in a physical model. The tip 104 of tether 103 is inserted into hole 117 of plug 109. Tether 103 is long enough so that the nameplate assembly 114 tends to want to fall off the magnetic fields away from post 102, but not so far as to cause tip 104 to let go of magnet 111A. The resulting balance keeps assembly 114 "levitating".

Figure 8:
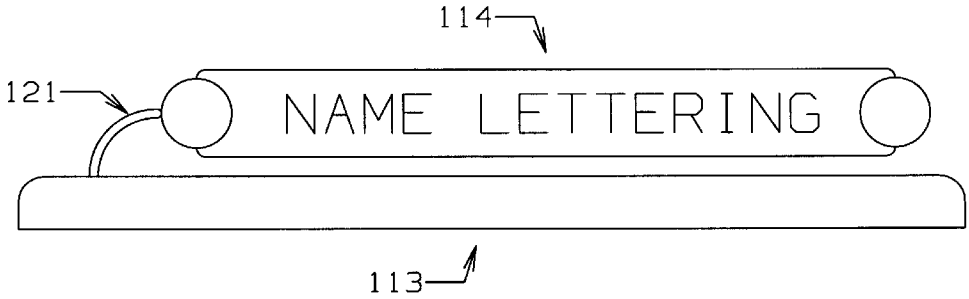
FIG. 8 is the front view of the assembly of both the base assembly and nameplate assembly in the alternate embodiment.

In FIG. 8, the entire base assembly 113 and nameplate assembly 114 are shown in their "levitating" state and appear as they do in an alternate model. In this embodiment, the post 102, screw 105, tether 103, and tip 104 are replaced by post 121. Post 121 is positioned such that the nameplate assembly 114 tends to want to fall off the magnetic fields toward post 121 but is kept in place by post 121.

The base 101, post 102, plugs 109 & 110, balls 108A & 108B, plate 107, and lettering 112 should be made from a non-ferrous material in order to not interfere with the magnetic fields generated by the magnets. Tip 104, however, must be made from a ferrous material. The screw 105 material is inconsequential as long as it provides sufficient strength to hold tether 103. Tether 103 is best made of a very thin material to be as "invisible" as possible. If post 121 is used instead of the tether assembly, it must be made of a non-ferrous material. All magnets 106 and 111 should have as much magnetic strength as possible for best results.

Since the levitating illusion is caused by the repelling effect of like-poled magnets, the arrangement of the magnets is crucial. Magnets 106A and 106B in the base 101 should repel the outboard side of magnet 111A while magnets 106C and 106D repel the inboard side. Likewise, magnets 106G and 106H should repel the outboard side of magnet 111B while magnets 106E and 106F repel the inboard side.

It is apparent now that nameplate formed according to the present invention will produce the desired result of conveying the user's name and/or title in a novel and creative manner. It also presents the illusion of levitation even though the tether is attached for balance.

With this disclosure, the applicant has provided a new and improved concept in the art of personal identification which yields a true advancement in the art. Many further modifications, alterations, embodiments; and artistic adaptations of this invention will now be apparent to those skilled in the art without exceeding the scope of the invention as defined in the following claims.

What is claimed is:

1. A magnetically levitated device for visually displaying information to an observer comprising a) a base assembly comprising a base, a plurality of magnets having flat ends, and a means for a tether attached at a predetermined height;

b) the tether with a means to attach it to one end of a floating assembly;

c) the floating assembly comprising a plurality of magnets, a display surface on which information is located, and physical magnet carriers for the floating assembly magnets to be attached to the display surface;

d) the floating assembly and the base assembly are positioned respective to each other to give the illusion that the floating assembly is levitating above the base assembly;

e) said magnet carriers of the floating assembly each contain a magnet having a flat end with the magnets placed co-axially with the length of the display surface;

f) the plurality of magnets of the base assembly are in two groups such that i) the distance from the center of mass of one group of base assembly magnets to the center of mass of the other group of base assembly magnets is the length of the display surface in addition to the thickness of a magnet in the floating assembly;

ii) said groups each contain at least two magnets positioned such that the floating assembly magnets are located above the groups and are slightly off center of the center of mass of the groups in the direction away from the tether;

iii) said magnets in the base assembly are positioned with the polarity such that they repulse the plurality of magnets in the floating assembly;

iv) said magnets in the base assembly and floating assembly are polarized axially such that the flat ends of the magnets are polarized.

2. A magnetically levitated device for visually displaying information as in claim 1 wherein said tether has a metal tip that is attracted to one of the magnets in the floating assembly.

3. A magnetically levitated device for visually displaying information as in claim 1 wherein said magnets are plug magnets.

4. A magnetically levitated device for visually displaying information as in claim 1 wherein said magnets are ring magnets.

5. A magnetically levitated device for visually displaying information as in claim 1 wherein said magnets are flat bar magnets or disc magnets.

6. A magnetically levitated device for visually displaying information as in claim 4 wherein said ring magnets are polarized radially with curved surfaces being polarized.

7. A magnetically levitated device for visually displaying information as in claim 1 wherein each group of magnets in the base assembly contains four magnets.

8. A magnetically levitated device for visually displaying information to an observer comprising a) a base assembly comprising a base, a plurality of magnets having a flat ends, and a support at a predetermined height;

b) the floating assembly comprising a plurality of a display surface on which information is located, and physical magnet carriers for the floating assembly magnets to be attached to the display surface;

c) the floating assembly and the base assembly are positioned respective to each other to give the illusion that the floating assembly is levitating above the base assembly;

d) said magnet carriers of the floating assembly each contain a magnet having a flat end with the magnets placed co-axially with the length of the display surface;

e) said plurality of magnets of base assembly are in two groups such that i) the distance from the center of mass of one group of base assembly magnets to the center of mass of the other group of base assembly magnets is the length of the display surface in addition to the thickness of a magnet in the floating assembly;

ii) said groups each contain at least two magnets positioned such that the floating assembly magnets are located above the groups and are slightly off center of the center of mass of the groups in the direction toward the support;

iii) said magnets in the base assembly are positioned with the polarity such that they repulse the plurality of magnets in the floating assembly;

iv) said magnets in the base assembly and floating assembly are polarized axially such that the flat ends of the magnets are polarized.

9. A magnetically levitated device for visually displaying information as in claim 8 wherein said support is a wall or surface that the floating assembly rests against.

10. A magnetically levitated device for visually displaying information as in claim 8 wherein said magnets are plug magnets.

11. A magnetically levitated device for visually displaying information as in claim 8 wherein said magnets are ring magnets.

12. A magnetically levitated device for visually displaying information as in claim 8 wherein said magnets are flat bar magnets or disc magnets.

13. A magnetically levitated device for visually displaying information as in claim 8 wherein each group of magnets in the base assembly contains four magnets.

14. A magnetically levitated device for visually displaying information as in claim 11 wherein said ring magnets are polarized radially with the curved surfaces being polarized.

* * * * *